United States Patent [19]

Kienle et al.

[11] 4,395,692

[45] Jul. 26, 1983

[54] APPARATUS FOR MAGNETIZING A CONVERGENCE DEVICE FOR IN-LINE COLOR-PICTURE TUBES AND METHODS OF ADJUSTING CONVERGENCE WITH SUCH APPARATUS

[75] Inventors: Erhard Kienle, Esslingen; Walter Kornaker, Berkheim; Felix Greiner, Stuttgart, all of Fed. Rep. of Germany

[73] Assignee: International Standard Electric Corporation, New York, N.Y.

[21] Appl. No.: 214,408

[22] Filed: Dec. 8, 1980

[30] Foreign Application Priority Data

Dec. 12, 1979 [DE] Fed. Rep. of Germany ..... 2949851

[51] Int. Cl.[3] ..... H01F 13/00

[52] U.S. Cl. ..... 335/284; 335/213

[58] Field of Search ..... 335/210, 212, 213, 284; 313/421, 427, 428, 429, 430, 431

[56] References Cited

U.S. PATENT DOCUMENTS

| | | | |
|---|---|---|---|
| 4,105,983 | 8/1978 | Barten et al. | 335/210 X |
| 4,138,628 | 2/1979 | Smith | 335/210 X |
| 4,159,456 | 6/1979 | Smith | 335/210 |
| 4,162,470 | 7/1979 | Smith | 335/210 |
| 4,189,659 | 2/1980 | Andre et al. | 335/210 X |

FOREIGN PATENT DOCUMENTS

| | | | |
|---|---|---|---|
| 2907898 | 11/1980 | Fed. Rep. of Germany | 335/284 |
| 741349 | 11/1978 | U.S.S.R. | 335/210 |

*Primary Examiner*—George Harris

*Attorney, Agent, or Firm*—John T. O'Halloran; Peter C. Van Der Sluys

[57] ABSTRACT

An apparatus is disclosed for magnetizing the convergence device of a color-picture tube including electrically excitable coils disposed around the tube neck and having their axes located in the convergence device plane. The cross sections of the coils in the convergence-device plane are greater than those perpendicular to this plane. This adaptation of the symmetry of the magnetizing coils to the symmetry of the convergence device makes it possible to exert a strong influence on the convergence device.

11 Claims, 4 Drawing Figures

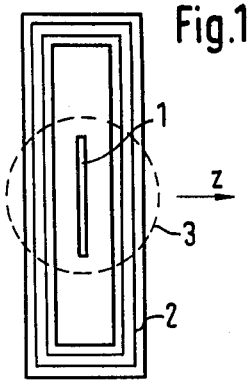
Fig.1
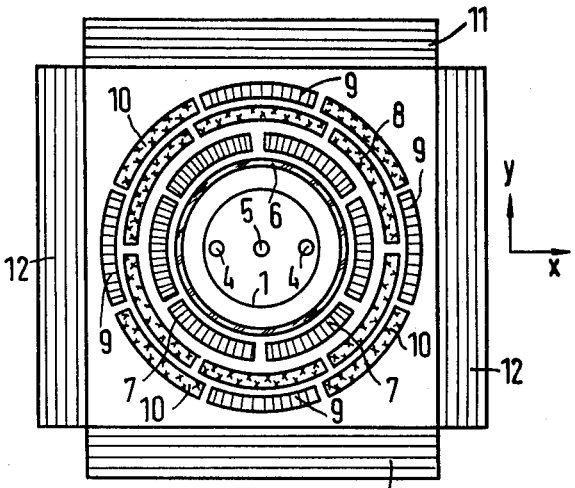
Fig.2
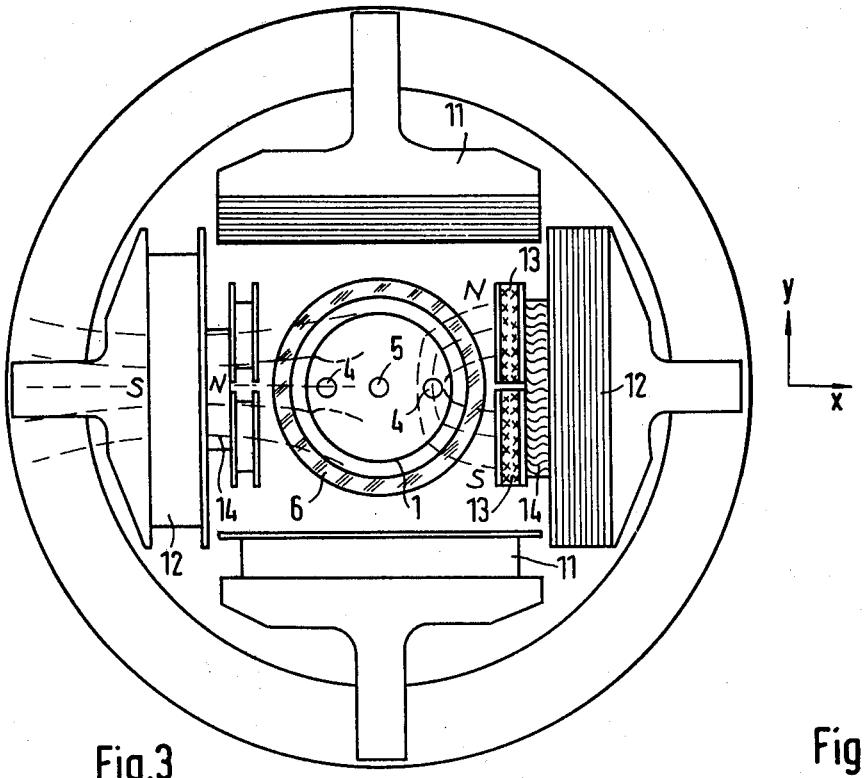
Fig.3
Fig.4
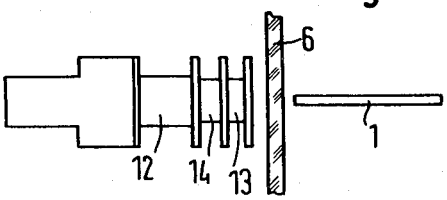

APPARATUS FOR MAGNETIZING A CONVERGENCE DEVICE FOR IN-LINE COLOR-PICTURE TUBES AND METHODS OF ADJUSTING CONVERGENCE WITH SUCH APPARATUS

BACKGROUND OF THE INVENTION

1. Field of the Invention

The present invention relates to an apparatus for magnetizing a convergence device for in-line color-picture tubes and to methods of adjusting convergence with such apparatus.

2. Description of the Prior Art

Color-picture tubes commonly have a screen provided with phosphors of three different colors. Each color of phosphor is excited by one of three electron beams emitted by an electron-gun system. Color-picture tubes in which the three electron guns of the electron-gun system are arranged in one plane are called "in-line color-picture tubes". In such in-line tubes, a so-called shadow mask is mounted between the electron-gun system and the luminescent screen. The electron beams pass through slit openings of the mask and strike the phosphor areas. For proper operation of the in-line color-picture tube it is necessary that all three electron beams intersect in each of the mask slits. To achieve this intersection, the electron beams are deflected in the electron-gun system by static magnetic fields. The adjustment of these magnetic fields is called "convergence adjustment".

The principle of such a convergence adjustment is described in the journal "Funkschau" 1976, No. 5, pages 59 and 60. In the principle described there, the two outer ones of the coplanar electron beams are first converged at the same point. To accomplish this, the two outer beams are moved synchronously with or relative to each other in the horizontal or vertical direction by means of four-pole fields. By means of six-pole fields, the two outer converged electron beams are movable together in relation to the central beam in the horizontal and vertical directions. Such adjusting movements will hereinafter be referred to as "deflection movements". To be able to perform other deflection movements, one of the outer electron beams is adjustable in the horizontal and vertical directions essentially independently of the central beam and the other outer beam. In this manner, each of the two outer beams is converged individually on the central beam.

In the above-mentioned "Funkschau" article, convergence adjustments are made by rotating premagnetized magnetic rings located around the neck of the tube above the electron-gun system. However, it is already known from German Pat. No. 961,735 to deflect an electron beam by placing a permanent magnet material inside the tube neck and selectively magnetizing or remagnetizing this material from outside.

It is customary to use hard magnetic materials for convergence adjustments. These materials are mounted inside the tube neck, possibly directly to the electron-gun system, and are magnetized or remagnetized from outside by means of a magnetizing apparatus. The present invention relates to magnetizing apparatus of the latter kind.

DE-OS No. 28 28 710 discloses apparatus and methods suitable for magnetizing and remagnetizing hard magnetic materials for making convergence adjustments. FIGS. 11 and 12 show two apparatus in each of which eight coils are disposed radially around a tube neck. The coils are wired up so that the two-, four-, and six-pole fields necessary for adjustment can be achieved. It has turned out that only small deflections of the electron beams are possible with such apparatus. In DE-OS No. 28 32 666, FIG. 2 shows a magnetizing apparatus in which the magnet coils are mounted in two planes and one behind the other in direction of the beams. This permits the number of coils to be increased considerably, which results in stronger magnetic fields and, hence, greater deflection. However, all deflection fields for electron beams change not only the direction of the beam but also its shape. For the shapes of the electron beams, deflection in two different planes has proved disadvantageous.

The electron beams are deflected by a convergence device to adjust not only convergence but color purity. Purity adjustment necessitates moving all three electron beams jointly in the horizontal direction. In the magnetizing apparatus described above, the two-pole fields necessary therefor are obtained by suitably connecting the radial, electrically excitable magnet coils. DE-OS No. 28 32 667 describes a different magnetizing apparatus in which purity is adjusted by means of conductors around the tube neck. The apparatus shown in FIG. 6 of that application uses two radial magnet coils located in two planes, and conductors arranged in a third plane in front of the two other planes. There, too, the problem of beam deformation arises as a result of the deflection in different planes.

SUMMARY OF THE INVENTION

Accordingly, the object of the invention is to provide a magnetizing apparatus for the above purpose which permits a very strong influence to be exerted on the electron beams with a minimum change in the cross-sectional shape of the beams.

The object of the invention is achieved using an apparatus for magnetizing the permanent-magnet convergence device of an in-line color-picture tube, wherein permanent magnets are located around the neck of the tube in a plane perpendicular to the tube axis. This plane shall hereinafter be referred to as the "convergence-device plane". The permanent magnets are magnetized or remagnetized by means of electrically excitable coils mounted around the neck of the tube and having their magnetic axes located in the convergence-device plane. By this magnetization, the electron beams in the tube are deflected relative to each other in different directions until they converge. The coils have cross sections whose dimensions in the convergence-device plane are greater than those perpendicular thereto, and the coil axes lie in the convergence-device plane.

Since the magnet coils have different cross-sectional shapes, they are adapted to the shape of the convergence device. As all coil axes lie in the plane of the convegence device, minimum changes in beam shape are insured. By the adaptation of the coil shapes to the shape of the convergence device, it is possible to produce very strong magnetic fields. This permits structures of the magnetizing apparatus in which the coils necessary to produce a certain multipole field can be arranged on circles with different radii around the tube neck. It has turned out that with such apparatus, magnetization is possible even through a deflection system placed around the tube neck; this is important because present-day deflection systems extend over such a long portion of the neck that they cover a large portion of the electron-gun system, so that convergence and purity adjustments have to be made before mounting the deflection system on the tube.

BRIEF DESCRIPTION OF THE DRAWINGS

FIG. 1 shows how the coil shape is adapted to the shape of the convergence device.

FIG. 2 shows an embodiment of a magnetizing apparatus according to the invention with magnet coils arranged radially around the tube neck.

FIG. 3 shows a second embodiment of a magnetizing apparatus according to the invention with which one of the outer electron beams can be influenced essentially independently of the central beam and the other outer beam.

FIG. 4 is a top view of a coil form of the apparatus of FIG. 3.

DESCRIPTION OF THE INVENTION

In FIG. 1, the convergence device of hard magnetic material to be magnetized is designated 1. It is, for example, a split magnetic ring located inside a tube neck. This ring is concentric with the central electron beam. The direction of the electron beams is designated z. The ring is located in the convergence-device plane, which is normal to the z-axis. Instead of a ring, other shapes of a convergence device of magnetizable material have been proposed, but the magnetizable material is always in a convergence-device plane as defined above. FIG. 1 shows a view of the wire ring 1 looking in the direction of the convergence-device plane, so the ring appears only as a stroke. Shown in front of the wire ring is an electrically excitable magnet coil 2 of rectangular cross section whose magnetic axis lies in the direction of view. The long side of the rectangular cross section lies in the convergence device plane. It can be seen that the coil shape fits well into the convergence device. To permit a comparison, the inner diameter of a round coil 3 is indicated by a broken line; the round coil covers the same area as the rectangular coil. It is readily apparent that with the rectangular coil, a homogenous field can be produced over the entire convergence device. With the round coil, however, marginal areas of the convergence device will be in the inhomogeneous fringing field of the coil. To achieve a homogeneous field over the entire convergence device, the diameter of the round coil 3 would have to be considerably increased. Then, however, only a much weaker field could be produced with the same current flowing through the coil. The maximum current flow is limited by the power source available. With this coil design, a considerably higher field strength can be achieved with a given power source. What is important is that all parts of the convergence device which have to be magnetized be located in a plane perpendicular to the beam axis.

Following is a description of the operation of the magnetizing apparatus of FIG. 2, which will be followed by information on the physical dimensions and electrical characteristics of the coils. Arranged on a first circle around the neck 6 are six coils 7, whose radial magnetic axes make angles of 60°. Two of the coil axes coincide with the x-axis. These coils are operated so as to produce a six-pole field by which the two outer electron beams are movable jointly relative to the central electron beam in the y-direction. Arranged on a second circle are six additional coils 8, whose magnetic axes are also separated by 60°. Two of the six magnetic axes of the coils coincide with the y-axis. These six coils are operated together so as to produce a six-pole field by which the two outer electron beams can be moved jointly relative to the central electron beam in the x-direction. Following on a third, even larger radius are eight coils whose magnetic axes make angles of 45° with each other. The four coils whose magnetic axes coincides with the x-axis and the y-axis, respectively, are designated 9 and shown hatched. The four coils whose magnetic axes make angles of 45° with the x- and y-axes are designated 10 and cross-dotted. The four coils 9 are operated so as to produce a four-pole field which allows the two outer beams to be moved relative to each other in the y-direction while leaving the central beam uninfluenced. By contrast, the four coils 10 are operated so as to produce a four-pole field which permits the two outer electron beams to be moved relative to each other in the x-direction while leaving the central beam uninfluenced. The coils for producing the four-pole fields may also be arranged along two radii, analogously to the six-pole coils.

The convergence coils described so far are arranged on circles with different radii. For purity adjustment, however, elongate coils are necessary which produce a like, homogeneous field for all three electron beams. The magnetic axes of the purity-correcting coils coincide with the y-axis. The two purity-correcting coils, arranged in the y-direction above and below the coils described so far, are operated so as to produce a two-pole field which moves all three electron beams jointly in the x-direction be equal amounts. The purity-correcting coils are designated 11. Analogously to the joint movement of all three electron beams in the x-direction, joint deflection of all three electron beams in the y-direction is frequently desired for raster adjustment. FIG. 2 shows two raster-correcting coils 12, whose magnetic axes coincide with the x-axis, and which are located in the x-direction to the left and to the right of the convergence coils. The two coils 12 are operated so as to produce a two-pole field.

All coils have rectangular cross sections. The long sides of the purity-correcting coils 11 and of the raster-correcting coils 12 are about twice to three times as long as the dimension of the convergence device in the x-direction and y-direction, respectively. The long sides of the convergence coils arranged on circles are so long that the coils on one circle just fill this circle. The short sides of all coils are about 1 cm long. Each of the purity- and raster-correcting coils has 95 windings of 0.5 $mm^2$ copper wire. Each of the other coils has 150 windings of 0.25-$mm^2$ copper wire. Coils assigned to the same deflection movement are connected in series and excited with different current directions by means of a capacitor of about 200 $\mu$F charged to 500 V.

The attainable deflections result in displacements of up to $\pm$35 mm on the screen of the color-picture tube.

The magnetizing apparatus so far described permits the two outer electron beams to be deflected relative to each other or jointly without acting on the central beam. The impression of the adjusted magnetic field into the material of the magnetizable and remagnetizable convergence device is done by a conventional method. Therefore, the impression of the adjusted magnetic field into the permanent-magnet material of the convergence device will not be described here.

FIG. 3 shows a further embodiment of the magnetizing apparatus according to the invention with which one of the two outer electron beams can be adjusted essentially independently of the central beam and the other outer beam. The convergence device is again a ring 1 of permanent-magnet wire in a tube neck 6. All dimensions of FIG. 3 are the true dimensions of a magnetizing apparatus as is used to magnetize a permanent-magnet material disposed inside the neck of a so-called thick-neck tube with an outer neck diameter of 36 mm. The design and operation of the purity-correcting coils 11 and the raster-correcting coils 12 are identical to those of the coils described with reference to FIG. 2. In FIG. 3, however, the wound magnet coils are shownn only on the right and above, while on the left and below, only the coil forms are shown. The movement of the right-hand electron beam 4 in the x-direction will be described first. Two coils 13, whose magnetic axes extend parallel, or are inclined at an angle, to the x-axis, and which are located on both sides of the x-axis at equal distances therefrom, are operated so that the polarity of one of the coils is exactly opposite to that of the other coil. Thus, magnetic lines leave one of the coils and, after forming a bend (indicated by broken lines on the right-hand side of FIG. 3) which is closed above the ring 1, enter the other coil. Therefore, the field acting on the right-hand electron beam extends essentially in the y-direction, which causes this beam to be moved in the x-direction. Since the magnetic field decreases as the square of the distance from the coils, the central electron beam and the other outer beam are hardly influenced. The movement of the one of the outer electron beams in the y-direction is illustrated in FIG. 3 by the example of the left-hand beam. A coil whose magnetic axis coincides with the x-axis is electrically excited, thus forming a north pole and a south pole. The magnetic lines of such a coil close via the extraneous field of the coil. As a result, the electron beam on the left is located in a magnetic field extending in the x-direction, as indicated by broken lines, so that the deflection in the y-direction takes place. The arrangement of the coils for deflecting an outer electron beam in the x- or y-direction has so far been explained only for one side of the magnetizing apparatus. Through its coil structure, however, the magnetizing apparatus acts both in the direction of the x-axis and in the direction of the y-axis, so that both outer electron beams can be deflected individually in the x- or y-direction essentially independently of each other and of the central beam.

FIG. 4 is a top view of a coil form as is used in FIG. 3 to wind the raster-correcting coils and the coils for independently deflecting one of the outer electron beams in the x- and y-directions. The distances of the coil form or of the coil wound thereon from the tube neck 6 and from the convergence device 1 are also shown in FIG. 4. The electrical design of the coil 12 corresponds to that described in connection with FIG. 2.

The above-described embodiments of a magnetizing apparatus according to the invention are suitable for magnetizing the permanent-magnetic material of a convergence device located inside the neck of a tube. Exactly the same structures, but with larger physical dimensions, can be used if permanent-magnet materials disposed around the outside of the tube neck have to be magnetized or remagnetized, or if the permanent-magnet material is located inside the tube neck while parts of a deflection system are disposed between the tube neck and the magnetizing apparatus. A particular advantage of the magnetizing apparatus according to the invention is that permanent-magnet material inside a tube neck can be magnetized or remagnetized even through parts of a deflection system.

What is claimed is:

1. Apparatus for magnetizing the permanent-magnet convergence device of an in-line color-picture tube, wherein permanent magnets located around the neck of the tube in a plane perpendicular to the tube axis, hereinafter referred to as "convergence-device plane", are magnetized or remagnetized, by which magnetization the electron beams in the tube are deflected relative to each other in different directions until they converge, said apparatus comprising:

electrically excitable coils mounted around the neck of the tube having their magnetic axes located in the convergence-device plane, said coils having cross sectional dimensions in the convergence-device plane greater than the dimensions perpendicular thereto, and coil axes lying in the convergence-device plane.

2. An apparatus as claimed in claim 1, wherein the cross sections of the coils are rectangular.

3. An apparatus as claimed in claim 1, wherein all coils which have to be excited to achieve a particular deflection movement are excitable independently of all other coils.

4. A method for simultaneously adjusting the electron beams produced by the electron guns of an in-line color-picture tube in the direction perpendicular to the plane of the electron guns (y-direction) using an apparatus as described in any one of claims 1 to 3, including the step of jointly exciting two magnet coils, one on either side of the neck with their magnetic axes coinciding with the x-axis, which is perpendicular to the y-direction.

5. A method of simultaneously adjusting the three electron beams produced by the electron guns of an in-line color-picture tube in the x-direction using an apparatus as described in any one of claims 1 to 3, including the step of jointly exciting two magnet coils, one on either side of the neck and with their magnetic axes coinciding with the y-axis.

6. A method of adjusting the two outer ones of the electron beams produced by the three electron guns of an in-line color-picture tube in the same direction on the x-axis using an apparatus as described in any one of claims 1 to 3, including the step of jointly exciting six like magnet coils spaced equal distances from the neck, the magnetic axes of adjacent coils including an angle of 60°, and the magnetic axes of two of the coils coinciding with the y-axis.

7. A method of adjusting the two outer ones of the electron beams produced by the three electron guns of an in-line color-picture tube in the same direction on the y-axis using an apparatus as described in any one of claims 1 to 3, including the step of jointly exciting six like magnet coils spaced equal distances from the neck, the magnetic axes of adjacent coils including an angle of 60°, and the magnetic axes of two of the coils coinciding with the x-axis.

8. A method of adjusting the two outer ones of the electron beams produced by the three electron guns of an in-line color-picture tube in opposite directions on the y-axis using an apparatus as described in any one of claims 1 to 3, including the step of jointly exciting four like magnet coils spaced equal distances from the neck, the magnetic axes of opposite coils coinciding with the x-axis and the y-axis.

9. A method of adjusting the two outer ones of the electron beams produced by the three electron guns of an in-line color-picture tube in opposite directions on the x-axis using an apparatus as described in any one of claims 1 to 3, including the step of jointly exciting four like magnet coils spaced equal distances from the neck, their magnetic axes making angles of 45° with the x-axis and the y-axis.

10. A method of adjusting one of the two outer electron beams in the y-direction essentially independently of the central electron beam and the other outer electron beam using an apparatus as described in any one of claims 1 to 3, wherein a magnet coil whose magnetic axis coincides with the x-axis is located on either side of the neck, including the steps of exciting only the coil on the side of the electron beam to be adjusted.

11. A method of adjusting one of the two outer electron beams in the x-direction essentially independently of the central electron beam and the other outer electron beam using an apparatus as described in any one of claims 1 to 3, wherein on either side of the neck there are provided two magnet coils whose magnetic axes extend parallel, or are inclined at a small angle, to the x-axis, and which are located on either side of and close to the x-axis, including the step of exciting with opposite polarity only the coils closest to the electron beam to be influenced.

* * * * *